US011293293B2

(12) United States Patent
Zha

(10) Patent No.: US 11,293,293 B2
(45) Date of Patent: Apr. 5, 2022

(54) TURBOMACHINES THAT INCLUDE A CASING TREATMENT

(71) Applicant: COFLOW JET, LLC, Cutler Bay, FL (US)

(72) Inventor: Gecheng Zha, Cutler Bay, FL (US)

(73) Assignee: COFLOW JET, LLC, Cutler Bay, FL (US)

( * ) Notice: Subject to any disclaimer, the term of this patent is extended or adjusted under 35 U.S.C. 154(b) by 172 days.

(21) Appl. No.: 16/252,943

(22) Filed: Jan. 21, 2019

(65) Prior Publication Data

US 2019/0226350 A1 Jul. 25, 2019

Related U.S. Application Data

(60) Provisional application No. 62/620,008, filed on Jan. 22, 2018.

(51) Int. Cl.
*F01D 9/06* (2006.01)
*F04D 27/02* (2006.01)
(Continued)

(52) U.S. Cl.
CPC ..... *F01D 9/06* (2013.01); *F04D 27/0207* (2013.01); *F04D 27/0238* (2013.01);
(Continued)

(58) Field of Classification Search
CPC .. F04D 29/526; F04D 29/685; F04D 27/0207; F04D 27/0238; F04D 27/009;
(Continued)

(56) References Cited

U.S. PATENT DOCUMENTS 1,580,577 A 4/1926 Baumann
1,714,608 A 5/1929 Massey
(Continued)

FOREIGN PATENT DOCUMENTS

CN 104176241 12/2014
CN 104149967 5/2015
(Continued)

OTHER PUBLICATIONS

"Fundamentals of Gas Turbine Engines" 2012; https://web.archive.org/web/20120905202602/https://www.cast-safety.org/pdf/3_engine_fundamentals.pdf (Year: 2012).*
(Continued)

*Primary Examiner* — Woody A Lee, Jr.
*Assistant Examiner* — Wesley Le Fisher
(74) *Attorney, Agent, or Firm* — MacMillan, Sobanski & Todd, LLC

(57) ABSTRACT

Turbomachine casing treatments are described. A turbomachine that includes an example of a turbomachine casing treatment includes a wheel, a casing, and a fluid pressurizer. The wheel has a hub that defines a rotational axis and a plurality of blades. The casing has a first end, a second end, and defines an inner surface that surrounds the plurality of blades, an inlet opening, an outlet opening, a passageway, and a channel that extends from the inlet opening to the outlet opening. The passageway extends from a first passageway opening that is defined on the inner surface and a second passageway opening that is defined on the inner surface and is disposed between the first passageway opening and the first end of the casing. The fluid pressurizer is disposed within the passageway.

20 Claims, 6 Drawing Sheets

(51) Int. Cl.
*F04D 29/52* (2006.01)
*F04D 29/68* (2006.01)

(52) U.S. Cl.
CPC ..... *F04D 29/526* (2013.01); *F04D 29/685* (2013.01); *F05D 2220/30* (2013.01); *F05D 2240/12* (2013.01); *F05D 2260/60* (2013.01)

(58) Field of Classification Search
CPC ..... F04D 27/02; F04D 27/0215; F01D 11/04; F01D 11/06
USPC ..... 415/58.5, 58.7
See application file for complete search history.

(56) References Cited

U.S. PATENT DOCUMENTS 1,771,257 A 7/1930 Ingram
1,772,196 A 8/1930 Wallace
1,806,927 A 5/1931 Aldrich
1,810,693 A 6/1931 Alfaro
1,845,307 A 2/1932 Maxwell
1,861,336 A 5/1932 Cox
1,888,871 A 11/1932 Apperman
1,993,419 A 3/1935 Stalker
2,039,676 A 5/1936 Zaparka
2,041,795 A 5/1936 Stalker
2,063,030 A 12/1936 Crouch
2,071,744 A 2/1937 Anathor-Henrikson
2,075,817 A 4/1937 Loerke
2,077,071 A 4/1937 Rose
2,078,854 A 4/1937 Jones
2,082,674 A 6/1937 Young
2,223,744 A 12/1940 Stalker
2,225,525 A 12/1940 Pitcairn
2,267,927 A 12/1941 Kightlinger
2,352,144 A 6/1944 Woods
2,406,918 A 9/1946 Stalker
2,421,694 A 6/1947 Hawkins
2,427,972 A 9/1947 Melchior
2,438,942 A 4/1948 Polk
2,464,726 A 3/1949 Stalker
2,469,902 A 5/1949 Stalker
2,478,793 A 8/1949 Trey
2,507,611 A 5/1950 Pappas et al.
2,511,504 A 6/1950 Hawkins
2,514,513 A 7/1950 Price
2,584,666 A 2/1952 Bockrath
2,597,769 A 5/1952 Ashkenas
2,605,983 A 8/1952 Stalker
2,619,302 A 11/1952 Loedding
2,714,495 A 8/1955 Focke
2,809,793 A 10/1957 Warner
2,892,582 A 6/1959 O'Rourke
2,910,254 A 10/1959 Razak
2,946,541 A 7/1960 Boyd
3,011,762 A 12/1961 Pouit
3,029,043 A 4/1962 Churchill
3,029,044 A 4/1962 Childress
3,039,719 A 6/1962 Platt
3,045,947 A 7/1962 Bertin et al.
3,055,614 A 9/1962 Thompson
3,097,817 A 7/1963 Towzey, Jr.
3,101,678 A 8/1963 Grube
3,128,063 A 4/1964 Kaplan
3,144,220 A 8/1964 Kittelson
3,161,377 A 12/1964 Balluff
3,261,576 A 7/1966 Valyi
3,262,658 A 7/1966 Reilly
3,291,420 A 12/1966 Laing
3,298,636 A 1/1967 Arnholdt
3,430,894 A 3/1969 Strand et al.
3,438,599 A 4/1969 Welzen
3,441,236 A 4/1969 Arnholdt
3,506,220 A 4/1970 Sbrilli
3,507,463 A 4/1970 Kuntz
3,540,681 A 11/1970 Orazi
3,545,701 A 12/1970 Bertin et al.
3,572,612 A 3/1971 Irbitis
3,576,300 A 4/1971 Palfreyman
3,586,267 A 6/1971 Ingelman-Sundberg
3,658,279 A 4/1972 Robertson
3,666,209 A 5/1972 Taylor
3,807,663 A 4/1974 Bartoe, Jr.
3,887,146 A 6/1975 Bright
3,917,193 A 11/1975 Runnels, Jr.
3,977,629 A 8/1976 Tubeuf
4,033,526 A 7/1977 Benson
4,086,022 A 4/1978 Freeman et al.
4,117,995 A 11/1978 Runge
4,375,937 A 3/1983 Cooper
4,375,938 A * 3/1983 Dussourd ..... F04D 15/00 415/143
4,381,091 A 4/1983 Pegram
4,391,424 A 7/1983 Bartoe, Jr.
4,398,683 A 8/1983 Schmetzer
4,398,688 A 8/1983 Williams
4,804,155 A 2/1989 Strumbos
4,828,203 A 5/1989 Clifton et al.
4,848,701 A 7/1989 Belloso
4,928,907 A 5/1990 Zuck
4,976,349 A 12/1990 Adkins
4,990,053 A 2/1991 Rohne
5,016,837 A 5/1991 Willis
5,098,034 A 3/1992 Lendriet
5,255,881 A 10/1993 Rao
5,280,863 A 1/1994 Schmittle
5,282,718 A 2/1994 Koff et al.
5,308,225 A * 5/1994 Koff ..... F04D 29/526 415/57.3
5,335,885 A 8/1994 Bohning
5,395,073 A 3/1995 Rutan et al.
5,474,417 A 12/1995 Privett et al.
5,542,149 A 8/1996 Yu
5,586,859 A * 12/1996 Nolcheff ..... F01D 11/08 415/173.1
5,607,284 A 3/1997 Byrne et al.
5,687,934 A 11/1997 Owens
5,707,206 A 1/1998 Goto et al.
5,765,777 A 6/1998 Schmittle
5,769,359 A 6/1998 Rutan et al.
5,899,416 A 5/1999 Meister et al.
6,089,503 A 7/2000 Volk
6,220,012 B1 4/2001 Hauser et al.
6,231,301 B1 5/2001 Barnett et al.
6,264,425 B1 7/2001 Keller
6,368,059 B1 4/2002 Maines
6,464,171 B2 10/2002 Ruffin
6,543,720 B2 4/2003 Ladd
6,585,479 B2 * 7/2003 Torrance ..... F01D 11/08 415/58.5
6,669,142 B2 12/2003 Saiz
6,796,533 B2 9/2004 Barrett et al.
6,896,221 B1 5/2005 Einarsson
6,935,833 B2 8/2005 Seitz
7,074,006 B1 7/2006 Hathaway et al.
7,104,143 B1 9/2006 Powell
7,143,983 B2 12/2006 McClure
7,308,762 B2 12/2007 Bath et al.
7,441,724 B2 10/2008 Parks
7,520,465 B2 4/2009 Mahjoub
7,575,412 B2 8/2009 Seitz
7,673,832 B2 3/2010 Meister
7,837,438 B2 11/2010 Campbell
7,878,458 B2 2/2011 Shmilovich et al.
8,128,037 B2 3/2012 Powell et al.
8,128,364 B2 3/2012 Pesetsky
8,191,820 B1 6/2012 Westra et al.
8,246,311 B2 8/2012 Pesetsky
8,251,317 B2 8/2012 Pitt
8,251,319 B2 8/2012 Jonker et al.
8,262,031 B2 9/2012 Zha et al.
8,302,903 B2 11/2012 Morgan et al.
8,448,892 B2 5/2013 Zhu
8,459,597 B2 6/2013 Cloft et al.

(56) References Cited

U.S. PATENT DOCUMENTS

| | | | | |
|---|---|---|---|---|
| 8,469,907 | B2 | 6/2013 | Ichihashi et al. | |
| 8,485,476 | B2 | 7/2013 | Zha et al. | |
| 8,561,935 | B2 | 10/2013 | Milde, Jr. | |
| 8,829,706 | B1 | 9/2014 | Sammy | |
| 9,115,594 | B2 | 8/2015 | Krautheim | |
| 9,611,865 | B2 * | 4/2017 | Morel | F04D 29/682 |
| 9,726,084 | B2 | 8/2017 | Duong et al. | |
| 9,815,545 | B1 | 11/2017 | Steer | |
| 9,822,792 | B2 * | 11/2017 | Guemmer | F04D 29/526 |
| 10,724,435 | B2 * | 7/2020 | Kroger | F04D 29/542 |
| 10,815,886 | B2 * | 10/2020 | Kroger | F02K 3/06 |
| 2002/0139894 | A1 | 10/2002 | Sorensen | |
| 2003/0035715 | A1 | 2/2003 | Torrance | |
| 2003/0150962 | A1 | 8/2003 | Orban | |
| 2005/0111968 | A1 | 5/2005 | Lapworth | |
| 2005/0152775 | A1 * | 7/2005 | Japikse | F04D 29/685 415/1 |
| 2005/0226717 | A1 * | 10/2005 | Xu | F04D 29/681 415/58.5 |
| 2006/0196633 | A1 | 9/2006 | Mahjoub | |
| 2007/0095970 | A1 | 5/2007 | Richardson | |
| 2007/0196204 | A1 | 8/2007 | Seitz | |
| 2007/0217902 | A1 | 9/2007 | Sirakov et al. | |
| 2007/0228222 | A1 | 10/2007 | Davis | |
| 2008/0044273 | A1 | 2/2008 | Khalid | |
| 2009/0014592 | A1 | 1/2009 | Zha | |
| 2009/0065631 | A1 | 3/2009 | Zha | |
| 2009/0095446 | A1 | 4/2009 | Hamstra et al. | |
| 2009/0108141 | A1 | 4/2009 | Shmilovich | |
| 2009/0173834 | A1 | 7/2009 | Prince et al. | |
| 2009/0263234 | A1 * | 10/2009 | Yin | F04D 29/4213 415/58.4 |
| 2010/0127129 | A1 | 5/2010 | Zha et al. | |
| 2011/0001000 | A1 | 1/2011 | Zhu | |
| 2011/0001020 | A1 | 1/2011 | Forgac | |
| 2011/0210211 | A1 | 9/2011 | Zha et al. | |
| 2011/0215172 | A1 | 9/2011 | Todorovic | |
| 2012/0043428 | A1 | 2/2012 | Goelling et al. | |
| 2012/0068020 | A1 | 3/2012 | Milde, Jr. | |
| 2012/0074264 | A1 | 3/2012 | Heaton | |
| 2012/0145834 | A1 | 6/2012 | Morgan et al. | |
| 2012/0237341 | A1 | 9/2012 | Simon | |
| 2013/0206920 | A1 | 8/2013 | Bichler et al. | |
| 2013/0266436 | A1 * | 10/2013 | Ibaraki | F01D 25/24 415/208.1 |
| 2014/0286746 | A1 | 9/2014 | Nichols et al. | |
| 2014/0369812 | A1 | 12/2014 | Caruel et al. | |
| 2016/0009374 | A1 | 1/2016 | Glezer | |
| 2016/0010652 | A1 * | 1/2016 | Lim | F04D 29/526 415/128 |
| 2016/0368339 | A1 | 12/2016 | Nam | |
| 2017/0159667 | A1 * | 6/2017 | Streit | F04D 29/545 |
| 2017/0033451 | A1 | 12/2017 | Zha | |
| 2017/0355450 | A1 | 12/2017 | Zha | |
| 2017/0355451 | A1 | 12/2017 | Zha | |
| 2018/0251211 | A1 | 9/2018 | Zha | |
| 2018/0363676 | A1 * | 12/2018 | Kroger | F04D 27/009 |
| 2018/0363677 | A1 * | 12/2018 | Kroger | F02C 7/04 |

FOREIGN PATENT DOCUMENTS

| | | |
|---|---|---|
| DE | 202011051844 U1 | 1/2012 |
| EP | 3254961 | 12/2017 |

OTHER PUBLICATIONS

European Patent Office. "Extended European Search Report" for EP application No. 19181825 1, dated Oct. 30, 2019, pp. 1-7.

European Patent Office, Extended European Search Report for Application No. 17175582.0, dated Nov. 9, 2017, pp. 1-5.

Espacenet, Patent Translate of DF202011051844, pp. 1-9, retrieved from Internet Apr. 11, 2018.

European Patent Office, Extended European Search Report for Application No. 18202156.8, dated Apr. 2, 2019, pp. 1-11.

World Intellectual Property Organization, English Translation of CN 104149967, retrieved from Internet Oct. 4, 2019, pp. 1-4.

World Intellectual Property Organization, English Translation of CN 104176241, retrieved from Internet Oct. 2, 2019, pp. 1-7.

* cited by examiner

TURBOMACHINES THAT INCLUDE A CASING TREATMENT

RELATED APPLICATION

This application claims the benefit of U.S. Provisional Application No. 62/620,008, filed Jan. 22, 2018. The entire disclosure of this related application is hereby incorporated into this disclosure by reference.

FIELD

The disclosure relates generally to the field of fluid systems. More particularly, the disclosure relates to turbomachines that include a casing treatment.

BACKGROUND

Stall is typical to all types of compressors (e.g., axial flow, centrifugal flow), an example of a turbomachine, and can be harmful to both the turbomachine's performance and the turbomachine itself. Various systems have been developed that attempt to address stall within compressors. For example, various grooves and other structures have been incorporated into the various components of compressors to increase stall margin and prevent stalling. However, these systems are passive in nature and do not adequately increase the stall margin.

Therefore, a need exists for new and useful turbomachines that include a casing treatment.

SUMMARY OF SELECTED EXAMPLE EMBODIMENTS

Various turbomachines that include a casing treatment are described herein.

An example turbomachine that includes a casing treatment includes a wheel, a casing, and a fluid pressurizer. The wheel has a hub that defines a rotational axis and a plurality of blades. Each blade of the plurality of blades has a root attached to the hub, a blade tip, a leading edge, and a trailing edge. Each blade of the plurality of blades extends from the root to the blade tip and from the leading edge to the trailing edge. The casing has a first end, a second end, and defines an inner surface that surrounds the plurality of blades, an inlet opening, an outlet opening, a passageway, and a channel that extends from the inlet opening to the outlet opening such that fluid can enter the casing through the inlet opening, pass through the channel, and exit the outlet opening. The passageway extends from a first passageway opening that is defined on the inner surface and is disposed between the first end of the casing and the second end of the casing and a second passageway opening that is defined on the inner surface and is disposed between the first passageway opening and the first end of the casing such that fluid can enter the passageway through the first passageway opening, pass through the passageway, and exit the passageway through the second passageway opening. The fluid pressurizer is disposed within the passageway and is configured to pressurize fluid that passes through the passageway.

Another example turbomachine that includes a casing treatment includes a wheel, a casing, and a plurality of fluid pressurizers. The wheel has a hub that defines a rotational axis and a plurality of blades. Each blade of the plurality of blades has a root attached to the hub, a blade tip, a leading edge, and a trailing edge. Each blade of the plurality of blades extends from the root to the blade tip and from the leading edge to the trailing edge. The casing has a first end, a second end, and defines an inner surface that surrounds the plurality of blades, an inlet opening, an outlet opening, a plurality of passageways, and a channel that extends from the inlet opening to the outlet opening such that fluid can enter the casing through the inlet opening, pass through the channel, and exit the outlet opening. Each passageway of the plurality of passageways extends from a first passageway opening that is defined on the inner surface and is disposed between the first end of the casing and the second end of the casing and a second passageway opening that is defined on the inner surface and is disposed between the first passageway opening and the first end of the casing such that fluid can enter each passageway through the first passageway opening, pass through the passageway, and exit each passageway through the second passageway opening. A fluid pressurizer of the plurality of fluid pressurizers is disposed in each passageway of the plurality of passageways. Each fluid pressurizer of the plurality of fluid pressurizers is configured to pressurize fluid that passes through a passageway of the plurality of passageways such that the fluid has a first pressure at the first passageway opening and the fluid has a second pressure at the second passageway opening that is greater than the first pressure. The fluid exiting a passageway of the plurality of passageways at the second passageway opening is directed toward the blade tip.

An example method for controlling a fluid passing through a turbomachine that includes a casing treatment includes the steps of: activating a turbomachine that includes a casing treatment, the turbomachine comprising: a wheel, a casing, and a fluid pressurizer disposed within a passageway defined by the casing and configured to pressurize fluid that passes through the passageway; and activating the fluid pressurizer such that fluid passing through the passageway is pressurized and exits a second passageway opening such that it is directed toward each blade of the plurality of blades.

Additional understanding of the exemplary turbomachines that include a casing treatment can be obtained by review of the detailed description, below, and the appended drawings.

DETAILED DESCRIPTION

The following detailed description and the appended drawings describe and illustrate various example embodiments of turbomachines that include a casing treatment. The description and illustration of these examples are provided to enable one skilled in the art to make and use a turbomachine that includes a casing treatment. They are not intended to limit the scope of the claims in any manner.

Figure 1:
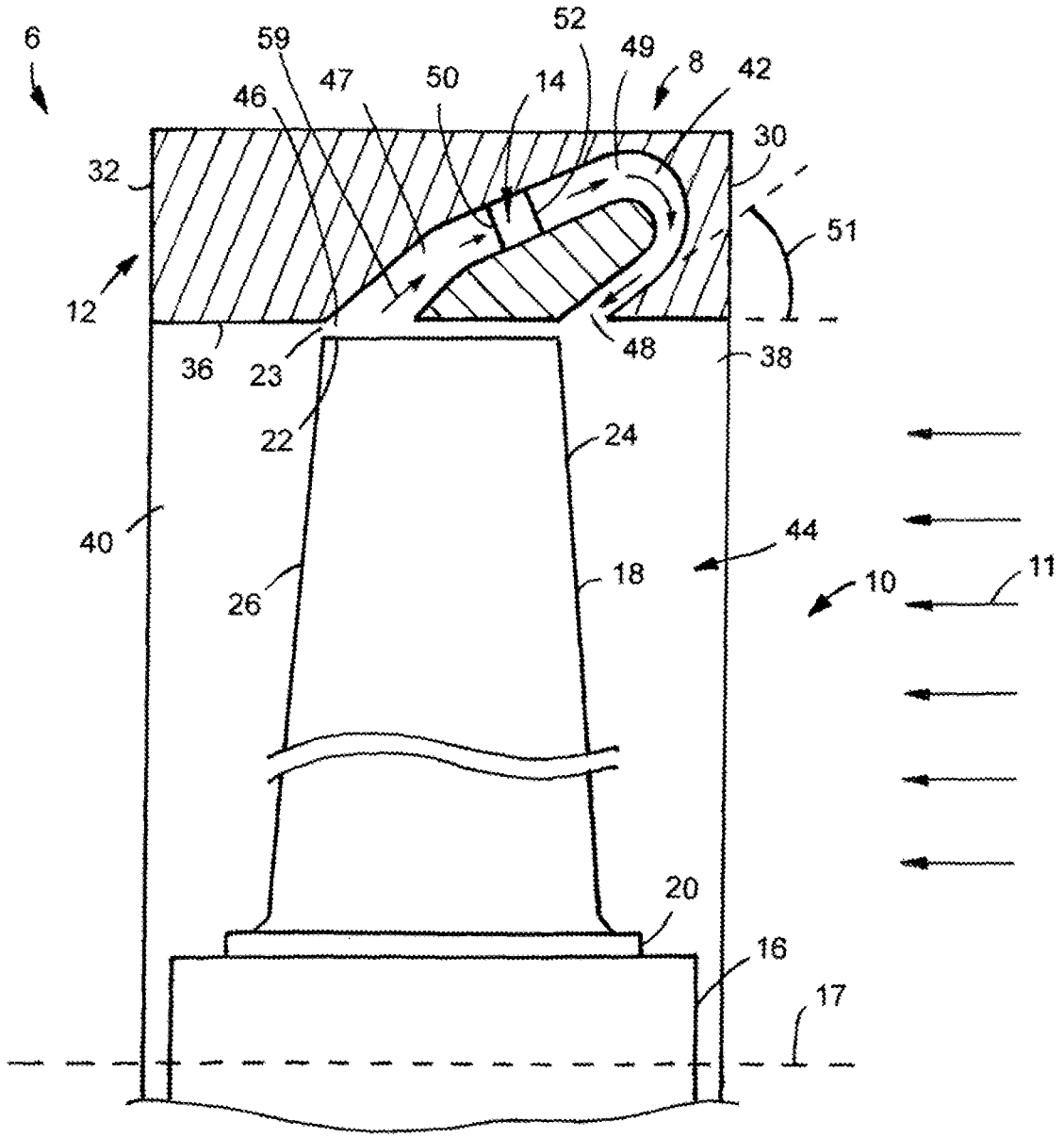
FIG. 1 is a partial cross-sectional view of a first example turbomachine that includes a casing treatment.
Figure 2:
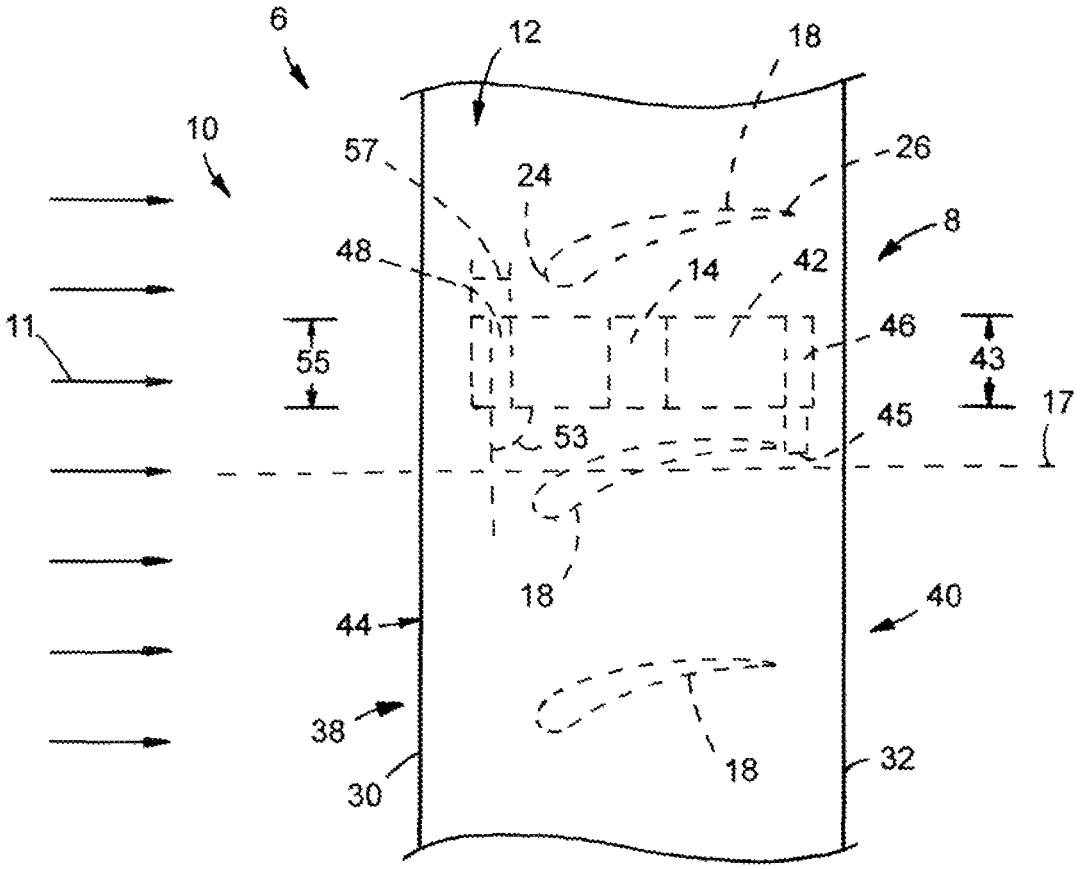
FIG. 2 is a partial top view of the turbomachine illustrated in FIG. 1.

FIGS. 1 and 2 illustrate a first example turbomachine 6 for compressing fluid that includes a casing treatment 8. The turbomachine 6 includes a wheel 10, a casing 12, and a fluid pressurizer 14. As shown in FIGS. 1 and 2, the direction of fluid flow 11 interacts with the turbomachine 8.

The wheel 10 has a hub 16 and a plurality of blades 18. The hub 16 defines a rotational axis 17. Each blade of the plurality of blades 18 has a blade root 20 attached to the hub 16, a blade tip 22, a tip clearance 23, a leading edge 24, and a trailing edge 26. Each blade of the plurality of blades 18 extends from the blade root 20 to the blade tip 22 and from the leading edge 24 to the trailing edge 26.

The casing 12 has a first end 30, a second end 32, and defines an inner surface 36, an inlet opening 38, an outlet opening 40, a passageway 42, and a channel 44. The inner surface 36 surrounds the plurality of blades 18. As best shown in FIG. 1, the blade clearance 23 extends from the blade tip 22 to the inner surface 36. The channel 44 extends from the inlet opening 38 to the outlet opening 40 such that fluid can enter the casing 12 through the inlet opening 38, pass through the channel 44 and past the plurality of blades 18, and exit the outlet opening 40. In addition, a portion of the fluid passing through channel 44 can also pass through passageway 42. The passageway 42 extends from a first passageway opening 46 to a second passageway opening 48. A casing 12 can define a passageway using any suitable structure and/or structural arrangement. For example, a casing can include a wall that defines a passageway. Alternatively, a first casing can define a recess that receives a portion, or the entirety, of a second casing that cooperatively defines the passageway with the first casing. The second casing can be attached to the first casing using any suitable method and/or technique of attachment, such as those described herein.

The first passageway opening 46 has a first cross-sectional area and the second passageway opening 48 has a second cross-sectional area that is less than the first cross-sectional area. However, alternative embodiments can include a second passageway opening that has a second cross-sectional opening that is greater than, or equal to, a first cross-sectional opening. The first passageway opening 46 is defined on the inner surface 36 and is disposed between the first end 30 of the casing 12 and the second end 32 of the casing 12. In the illustrated embodiment, the first passageway opening 46 is disposed adjacent to the trailing edge 26 of each blade of the plurality of blades 18. Alternative embodiments, however, can include a first passageway opening that is disposed between an axis that is orthogonal to the rotational axis and includes the trailing edge at the blade tip and the first end of a casing, a first passageway opening that is partially disposed on an axis that is orthogonal to the rotational axis and includes the trailing edge at the blade tip, a first passageway opening that is disposed between an axis that is orthogonal to the rotational axis and includes the trailing edge at the blade tip and the second end of a casing, or a first passageway opening that is disposed between an axis that is orthogonal to the rotational axis and includes the leading edge at the blade tip and the second end of a casing (e.g., any location downstream of the leading edge at the blade tip that the pressure through the channel 44 is higher than the flow pressure at the leading edge). The second passageway opening 48 is defined on the inner surface 36 and is disposed between the first passageway opening 46 and the first end 30 of the casing 12 such that fluid can enter the passageway 42 through the first passageway opening 46, pass through the passageway 42, and exit the passageway 42 through the second passageway opening 48. In the illustrated embodiment, the second passageway opening 48 is disposed adjacent to the leading edge 26 of each blade of the plurality of blades 18. Alternative embodiments, however, can include a second passageway opening that is disposed between an axis that is orthogonal to the rotational axis and includes the leading edge at the blade tip and the first end of a casing, a second passageway opening that is partially disposed on an axis that is orthogonal to the rotational axis and includes the leading edge at the blade tip, or a second passageway opening that is disposed between an axis that is orthogonal to the rotational axis and includes the leading edge at the blade tip and the second end of a casing. The first passageway 46 has a length 43 measured along the inner surface 36 about the rotational axis 17 and a width 45 measured along an axis that is parallel to the rotational axis 17. The second passageway 48 has a length 55 measured along the inner surface 36 about the rotational axis 17 and a width 57 measured along an axis that is parallel to the rotational axis 17. In the illustrated embodiment, the length 43 and length 55 are equal to one another. Alternatively, the length of any opening can be equal to, greater than, or less than about 0.1% of the blade tip pitch distance (e.g., the circumferential distance between two blades at the same axial location), between about 1% and about 100% of the blade tip pitch distance, or any other width considered suitable for a particular embodiment. In the illustrated embodiment, the width 45 and width 57 are equal to one another. Alternatively, the length of any opening can be between about 0.1% and about 50% of the blade tip airfoil chord length (e.g., a blade can be stacked by a series of airfoils along a span and the airfoil at the blade tip is the tip airfoil), between about 1% and about 10% of the blade tip airfoil chord length, or any other width considered suitable for a particular embodiment.

In the illustrated embodiment, a portion of the casing 12 that defines the second passageway opening 48 is disposed at a first angle 51 relative to the inner surface 36 (e.g., angle between the tangent of the outlet angle at the second passageway opening 48 and the inner surface) such that fluid exiting the passageway 42 at the second passageway opening 48 is directed toward the blade tip 22 at the leading edge 24. In the illustrated embodiment, the first angle is between about 0 degrees and about 90 degrees and is taken along a plane that contains the rotational axis 17. Alternative embodiments, however, can include a portion of the casing that defines the second passageway opening such that it is disposed at a first angle relative to the inner surface such that fluid exiting the passageway at the second passageway opening is directed toward the blade tip between the leading edge and the trailing edge, or at the leading edge between the blade tip and the blade root.

In the illustrated embodiment, a portion of the casing 12 that defines the second passageway opening 48 is disposed at a second angle 53 relative to a plane that is orthogonal to the rotational axis 17 (e.g., angle between the tangent of the outlet angle at the second passageway opening 48 and the plane). In the illustrated embodiment, the second angle is between about 0 degrees and about 180 degrees. Alternative embodiments, however, can include a portion of a casing that defines the second passageway opening such that it is disposed at a second angle relative to a plane that is orthogonal to the rotational axis that is between about 45 degrees and about 135 degrees, or about 90 degrees.

The fluid pressurizer 14 is disposed within the passageway 42 and provides a mechanism for pressurizing the fluid 59 passing through the passageway 42 during use. In the illustrated embodiment, the fluid pressurizer 14 is disposed a first distance from the first passageway opening 46 when traveling through the passageway 42 from the first passageway opening 46 to the fluid pressurizer 14 and a second distance from the second passageway opening 48 when traveling through the passageway 42 from the fluid pressurizer 14 to the second passageway opening 48. The first distance is less than the second distance. However, alternative embodiments can include a fluid pressurizer in which the first distance is greater than, or equal to, the second distance. A fluid pressurizer included in a turbomachine that includes a casing treatment can comprise any suitable device, system, or component capable of pressurizing fluid and selection of a suitable fluid pressurizer can be based on various considerations, such as the structural arrangement of a passageway within which a fluid pressurizer is intended to be disposed. Examples of fluid pressurizers considered suitable to include in a turbomachine that includes a casing treatment include electric pumps, pneumatic pumps, hydraulic pumps, micro-pumps, fans, compressors, micro-compressors, vacuums, and blowers. In the illustrated embodiment, the fluid pressurizer 14 is a micro-compressor.

In the illustrated embodiment, the fluid pressurizer 14 is disposed (e.g., entirely) within the passageway 42, is moveable between an off state and an on state, and has a suction port 50 and a discharge port 52. It is considered advantageous to include a fluid pressurizer 14 in a passageway 42 defined by a casing 12 at least because the inclusion of a fluid pressurizer 14 provides a mechanism for pressurizing fluid that passes through the passageway 42 such that it forms a jet as the fluid exits the second passageway opening 48. This is considered advantageous at least because it provides a mechanism for increasing the stall margin of the turbomachine 6. The fluid pressurizer 14 can be operatively connected to any suitable portion of a turbomachine 6 and/or the device, system, or component on which the turbomachine 6 is disposed to provide power to the fluid pressurizer (e.g., battery, electric motor) and to provide a mechanism for moving the fluid pressurizer between the off state and the on state (e.g., one or more switches). Alternative embodiments can include a fluid pressurizer that can vary the degree to which fluid is pressurized through the passageway 42. Examples of mass flow rates considered suitable through a passageway (e.g., passageway 42) and/or a passageway opening (e.g., first passageway opening 46, second passageway opening 48) include mass flow rates that are greater than, less than, or equal to 1%, 5%, 10%, 20%, or 30% of the mass flow rate passing through a channel (e.g., channel 44), and any other mass flow rate that effectively extends the stall margin of a turbomachine with minimal impact to efficiency. The inventor has determined that a mass flow rate that is less than 10% of the mass flow rate passing through a channel is considered advantageous.

The fluid pressurizer 14 is attached to the casing 12 and is positioned such that the suction port 50 is directed toward a first portion of the passageway 47 that extends from the first passageway opening 46 to the fluid pressurizer 14 (e.g., the suction port 50 is directed toward the first passageway opening 48) and the discharge port 52 is directed toward a second portion of the passageway 49 that extends from the second passageway opening 48 to the fluid pressurizer 14 (e.g., the discharge port 52 is directed toward the second passageway opening 48). In the off state, the fluid pressurizer does not pressurize fluid passing through the passageway 42. In the on state, the fluid pressurizer draws fluid through the suction opening 50, through the fluid pressurizer 14, and pushes fluid out of the discharge port 52 and the second passageway opening 48. When in the on state, the fluid entering the passageway 42 at the first passageway opening 46 has a first velocity and the fluid exiting the passageway 42 at the second passageway opening 48 has a second velocity that is greater than the first velocity and is directed toward the blade tip. In addition, the fluid entering the passageway 42 at the first passageway opening 46 has a first pressure and the fluid exiting the passageway 42 at the second passageway opening 48 has a second pressure that is greater than the first pressure. Alternative embodiments, however, can include a casing treatment that is sized and configured such that fluid exiting a second passageway opening has a second velocity that is greater than a first velocity, a second pressure that is greater than a first pressure, that is directed toward a blade tip, that is directed toward the flow of fluid passing through a channel (e.g., channel 44), and/or that is directed toward the flow of fluid passing through a channel (e.g., channel 44) at a blade tip.

A fluid pressurizer can be attached to a casing 12 using any suitable technique or method of attachment and selection of a suitable technique or method of attachment between a fluid pressurizer and a casing can be based on various considerations, including the material(s) that forms the fluid pressurizer and/or the casing. Example techniques and methods of attachment considered suitable include welding, fusing, using adhesives, mechanical connectors, and any other technique or method considered suitable for a particular embodiment. In the illustrated embodiment, the fluid pressurizer 14 is attached to the casing 12 using mechanical connectors (e.g., screws, bolts).

In the illustrated embodiment, the casing treatment 8 comprises the passageway 42 defined by the casing 12 and the fluid pressurizer 14. However, in alternative embodiments, a casing treatment can include other features and/or components, such as a plurality of passageways, a plurality of fluid pressurizers, and/or one or more ducts.

Figure 3:
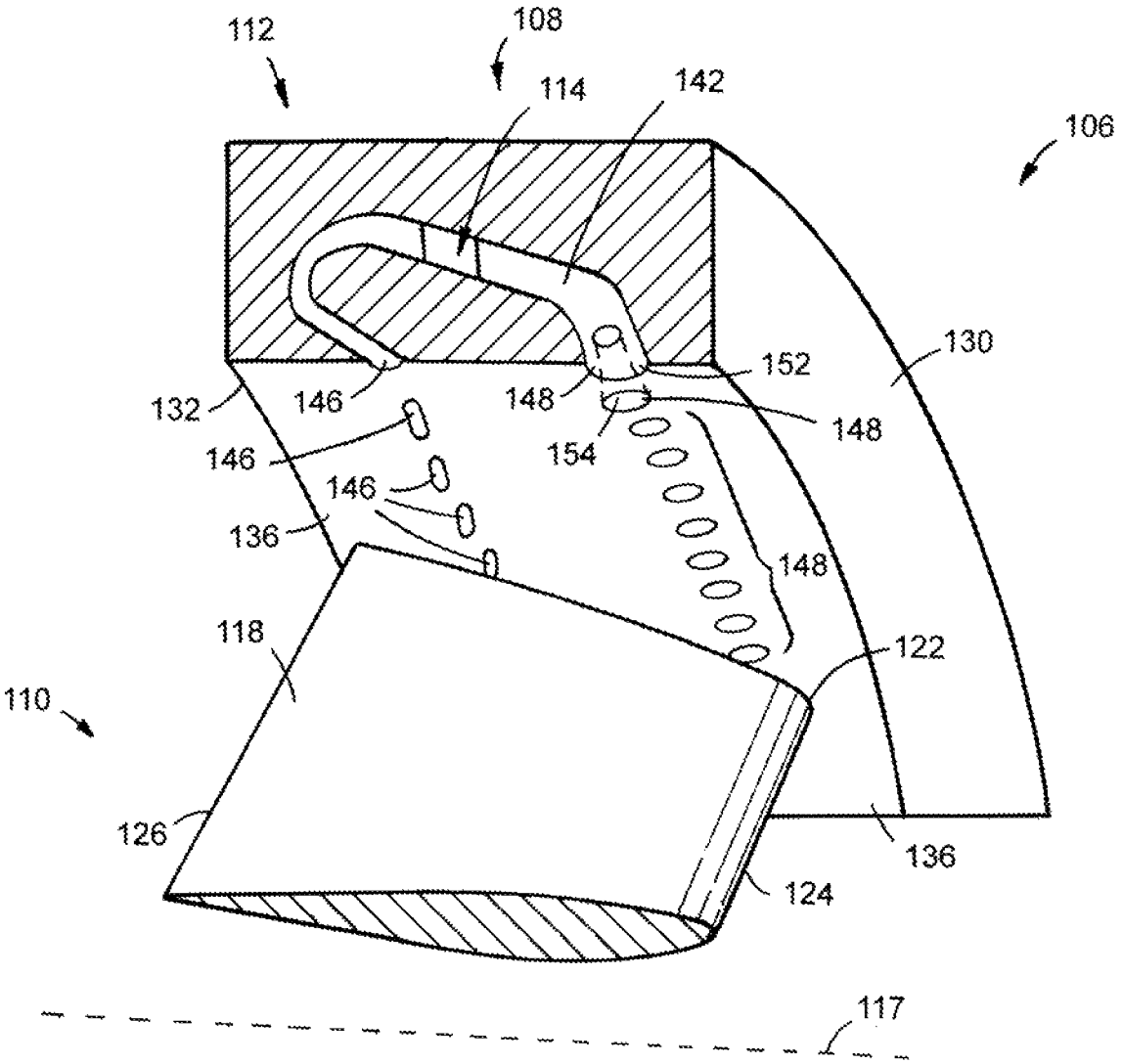
FIG. 3 is a partial cross-sectional view of a second example turbomachine that includes a casing treatment.
Figure 4:
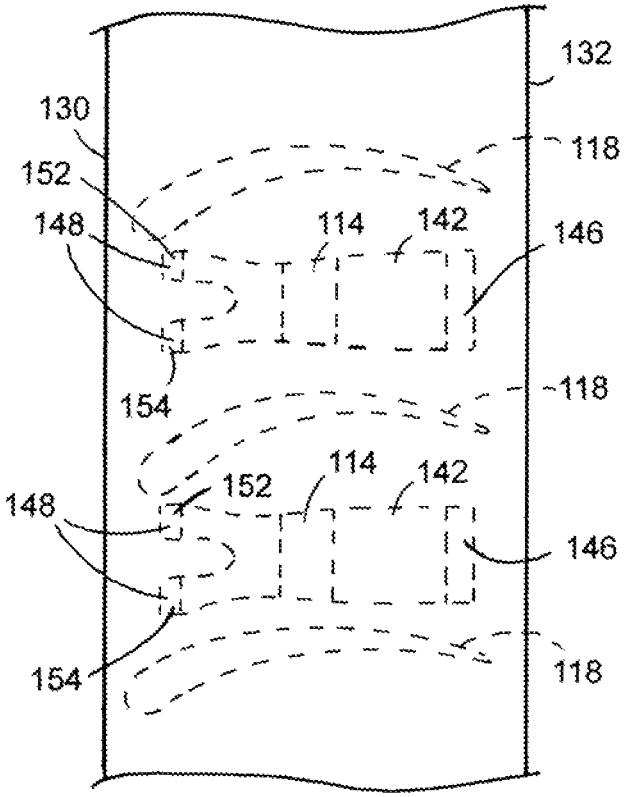
FIG. 4 is a partial top view of the turbomachine illustrated in FIG. 3.

FIGS. 3 and 4 illustrate a second example turbomachine 106 for compressing fluid that includes a casing treatment 108. The turbomachine 106 is similar to the turbomachine 6 illustrated in FIGS. 1 and 2 and described above, except as detailed below. The turbomachine 106 includes a wheel 110, a casing 112, and a plurality of fluid pressurizers 114.

In the illustrated embodiment, the casing 112 defines a plurality of passageways 142. Each passageway of the plurality of passageways 142 extends from a first passageway opening 146 to a plurality of second passageway openings 148. A fluid pressurizer of the plurality of fluid pressurizers 114 is disposed in each passageway of the plurality of passageways 142. In the illustrated embodiment, the casing 112 has a circumference and each passageway of the plurality of passageways 142 is equally spaced from adjacent passageways around the circumference of the casing 112. However, alternative embodiments can include a plurality of passageways that are not equally spaced from adjacent passageways around the circumference of a casing.

The inclusion of a plurality of second passageway openings 148 is considered advantageous at least because it provides a mechanism for directing multiple discrete jets of fluid that exit each opening of the plurality of second openings 148 toward each blade of the plurality of blades 118 during use. The first passageway opening 146 is defined on the inner surface 136 and is disposed between the first end 130 of the casing 112 and the second end 132 of the casing 112. In the illustrated embodiment, the first passageway opening 146 is disposed between an axis that is orthogonal to the rotational axis 117 and includes the trailing edge 126 at the blade tip 122 and the first end 130 of a casing 112. Each opening of the plurality of second passageway openings 148 is defined on the inner surface 136 and is disposed between the first passageway opening 146 and the first end 130 of the casing 112 such that fluid can enter the passageway 142 through the first passageway opening 146 and exit the passageway 142 through each opening of the second passageway openings 148. In the illustrated embodiment, each opening of the plurality of second passageway openings 148 is disposed between an axis that is orthogonal to the rotational axis 117 and includes the leading edge 124 at the blade tip 122 and the second end of a casing 132. Alternative embodiments can include a passageway that includes a plurality of first passageway openings and/or a plurality of second passageway openings.

In the illustrated embodiment, the plurality of second passageway openings 148 includes two passageway openings 152, 154 that are each in communication with the passageway 142 and the first passageway opening 146. However, alternative embodiments can include any suitable number of first passageway openings and/or second passageway openings that are each in communication with a passageway. Example numbers of passageway openings considered suitable to include in a plurality of first passageway openings and/or a plurality of second passageway openings include two, a plurality, three, four, five, six, seven, eight, nine, ten, less than ten, more than ten, one hundred, less than one hundred, more than one hundred, such that the number of openings is equal to the number of blades included in the plurality of blades, and any other number considered suitable for a particular embodiment. In addition, alternative embodiments can include a fluid pressurizer of a plurality of fluid pressurizers disposed in one or more passageways of a plurality of passageways, a fluid pressurizer of a plurality of fluid pressurizers disposed in a majority number of, or a minority number of, passageways of a plurality of passageways, or in any other number of passageways considered suitable for a particular embodiment.

A plurality of passageways 142 can include any suitable number of passageways and selection of a suitable number of passageways can be based on various considerations, including the total fluid flow intended to be passed through the plurality of passageways. Examples of numbers of passageways considered suitable to include in a casing include one, two, a plurality, three, four, five, six, seven, eight, nine, ten, less than ten, more than ten, one hundred, less than one hundred, more than one hundred, between two passageways and the specific number of blades included in a plurality of blades, between two passageways and ten passageways, more than ten passageways, and any other number considered suitable for a particular embodiment.

FIGS. 5, 6, 7, and 8 illustrate a third example turbomachine 206 for compressing fluid that includes a casing treatment 208. The turbomachine 206 is similar to the turbomachine 6 illustrated in FIGS. 1 and 2 and described above, except as detailed below. The turbomachine 206 includes a wheel 210, a casing 212, and a fluid pressurizer 214.

Figure 6:
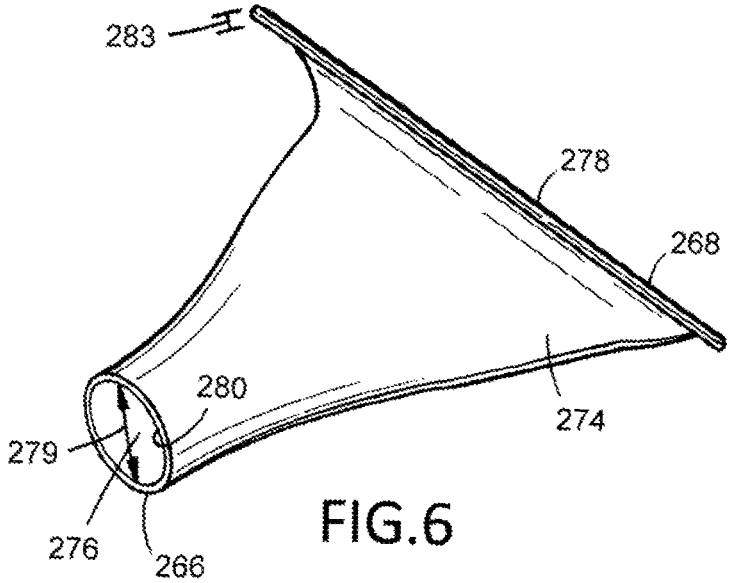
FIG. 6 is a perspective view of a duct included in the turbomachine illustrated in FIG. 5.
Figure 7:
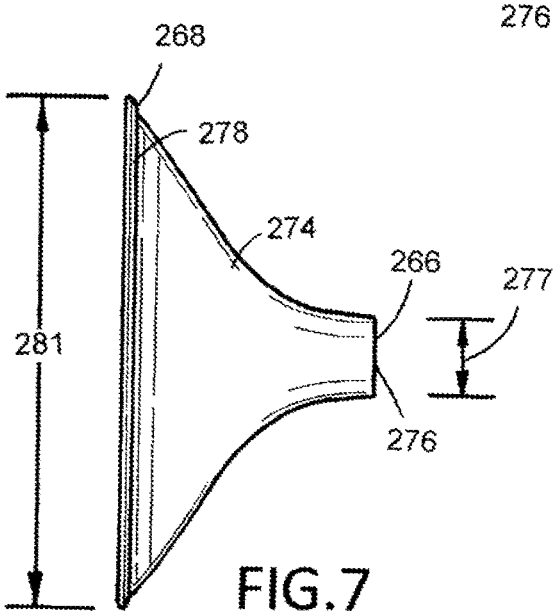
FIG. 7 is a top view of the duct illustrated in FIG. 6.
Figure 8:
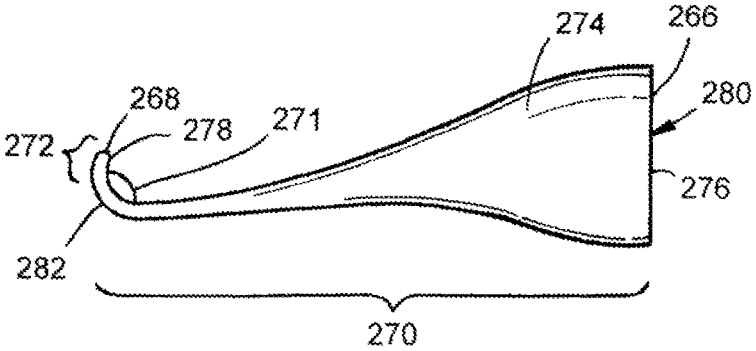
FIG. 8 is a side view of the duct illustrated in FIG. 6.

In the illustrated embodiment, a plurality of ducts 260 is disposed within the passageway 242 and includes a suction duct 262 and an injection duct 264. Each duct of the plurality of ducts 260 is attached to a port of the fluid pressurizer 214, is entirely disposed within the passageway 242, and, as best shown in FIGS. 6, 7, and 8, which illustrates an example duct that can be included in a casing treatment, has a first end 266, a second end 268, a first portion 270, a second portion 272, and a main body 274 that defines a first opening 276 at the first end 266, a second opening 278 at the second end 268, a passageway 280 that extends from the first opening 276 to the second opening 278, and a curve 282 between the first end 266 and the second end 268. The suction duct 262 is attached to the suction port 250 of the fluid pressurizer 214 and extends from the fluid pressurizer 214 toward the first passageway opening 246. The injection duct 264 is attached to the discharge port 252 of the fluid pressurizer 214 and extends from the fluid pressurizer 214 toward the second passageway opening 248. The first portion 270 extends from the first end 266 toward the second end 268 and the second portion 272 extends from the second end 268 toward the first end 266. The first portion 270 is disposed at an angle 271 relative to the second portion 272. In the illustrated embodiment, the angle 271 is greater than 90 degrees with respect to the suction duct 262 and is less than 90 degrees with respect to the injection duct 264. However, other angles can be utilized, such as angles that are between about 80 degrees and 180 degrees, between about 70 degrees and about 110 degrees, between about 45 degrees and between about 80 degrees, and any other angle considered suitable for a particular embodiment.

Each duct of the plurality of ducts 260 is attached to the casing 212 and the fluid pressurizer 214. A duct can be attached to a casing and/or a fluid pressurizer using any suitable technique or method of attachment and selection of a suitable technique or method of attachment can be based on various considerations, including the material(s) that forms a duct, a casing, and/or a fluid pressurizer. Example techniques and methods of attachment considered suitable include welding, fusing, using adhesives, mechanical connectors, and any other technique or method considered suitable for a particular embodiment. In the illustrated embodiment, each duct of the plurality of ducts 260 is attached to the casing 212 and the fluid pressurizer 214 using mechanical connectors (e.g., screws, bolts). Alternative embodiments, however, can include one or more ducts that are only attached to a casing or a fluid pressurizer.

The first opening 276 has a first opening length 277, a first opening height 279, and a first opening cross-sectional area and the second opening 278 has a second opening length 281, a second opening height 283, and a second opening cross-sectional area that is less than the first opening cross-sectional area. The first opening length 277 is equal to the first opening height 279, is less than the second opening length 281, and is greater than the second opening height 283. The second opening height 283 is less than the second opening length 281, is less than the first opening length 277, and is less than the first opening height 279. The second opening height 283 is equal to between about 0.01% and about 100% of the first opening height 279. The term "about" allows for a 10% variation in a listed value. Alternative embodiments, however, can include a second opening that has a second opening height that is about 2% of a first opening height, about 10% of a first opening height, between about 2% and about 10% of a first opening height, between about 2% and about 50% of a first opening height, and any other height considered suitable for a particular embodiment. The second opening cross-sectional area can be equal to any suitable value, such as equal to between about 10% and about 100% of the first opening cross-sectional area, between about 0.01% and about 10% of the first opening cross-sectional area, between about 0.01% and about 200% of the first opening cross-sectional area, and any other suitable value. In the illustrated embodiment, the length of the passageway 280 increases from the first end 266 to the second end 268 and the height of the passageway 280 decreases from the first end 266 to the second end 268. In the illustrated embodiment, the first opening 276 is centered relative to the second opening 278 such that the center of the first opening 276 is disposed on a plane that extends through the entire passageway 280 and contains the center of the second opening 278. Alternative embodiments, however, can include a first opening that is offset relative to the center of a second opening such that the center of the first opening is disposed on a first plane that extends through the passageway and is disposed parallel to a second plane that contains the center of the second opening and extends through the passageway.

As shown in FIGS. 6, 7, and 8, the first opening 276 has a first structural configuration and the second opening 278 has a second structural configuration that is different than the first structural configuration. As shown best in FIG. 6, the first opening 276 is circular and the second opening 278 is rectangular such that the cross-sectional configuration of the passageway 280 transitions from the first end 266 to the second end 268. While the first opening 276 has been illustrated as being circular and the second opening 278 has been illustrated as being rectangular, a first opening and a second opening of a duct can have any suitable structural configuration relative to one another. Selection of a suitable structural configuration for a first opening and a second opening of a duct can be based on various considerations, including the intended use of a fluid system. Examples of structural configurations considered suitable for a first opening and/or a second opening of a duct include those that are the same, those that are different from one another, rectangular, square, circular, oval, elliptical, and/or any other structural arrangement considered suitable for a particular embodiment.

Figure 5:
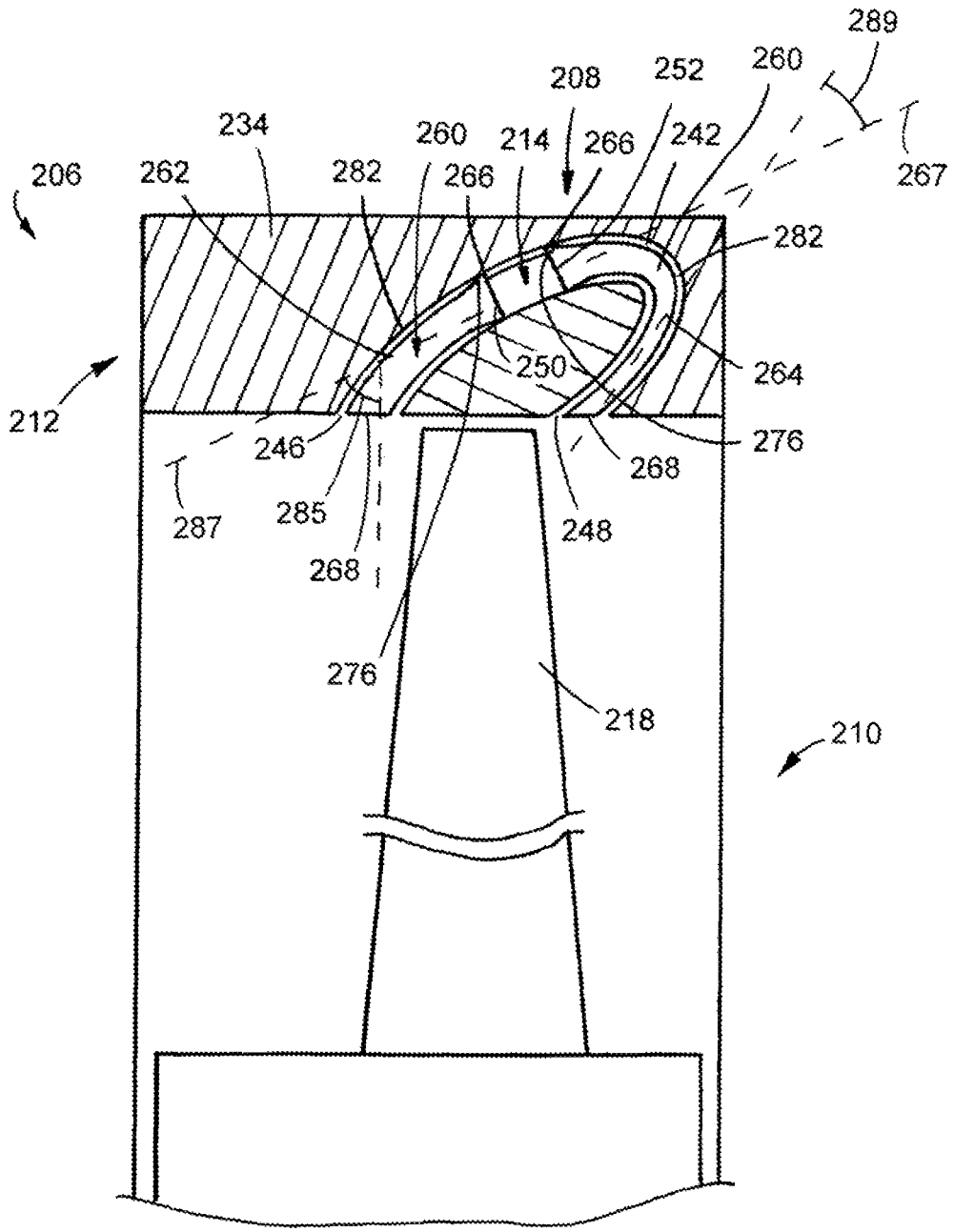
FIG. 5 is a partial cross-sectional view of a third example turbomachine that includes a casing treatment.

As shown in FIG. 5, the suction duct 262 has a length that is less than the length of the injection duct 264. The suction duct 262 is configured to allow a fluid to pass through the passageway 280 from the second opening 278 to the first opening 276 such that the fluid enters the passageway 280 at the second end 268 at an angle 285 relative to an axis 287 that extends through the first opening 276 and a portion of the passageway 280 that extends from the first opening 276 toward the second opening 278. In the illustrated embodiment, the suction duct 262 is sized and configured to be disposed within the passageway 242 and prevent fluid from traveling through the passageway 242 (e.g., such that fluid can only pass through suction duct 262 to the fluid pressurizers). The injection duct 264 has a lengthwise axis 267 that extends through the first opening 276 and the first portion 270. The injection duct 264 is configured to allow a fluid to pass through the passageway 280 from the first opening 276 to the second opening 278 such that the fluid exits the passageway 280 at the second end 268 at an angle 289 measured along an axis that passes through the lengthwise axis 267, away from the second end 268, and toward each blade of the plurality of blades 218.

Figure 9:
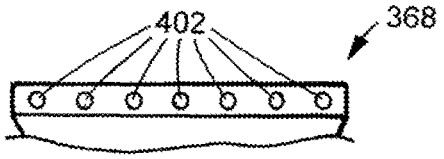
FIG. 9 is a partial view of another example duct.

While the turbomachine 206 has been illustrated as including only a single fluid pressurizer 214 having a particular structural arrangement and a plurality of ducts 260 attached to the fluid pressurizer 214 and having a particular structural arrangement, a turbomachine can include any suitable number of fluid pressurizers and ducts having any suitable structural arrangement. Selection of a suitable number of fluid pressurizers and/or ducts to include in a turbomachine can be based on various considerations, including the intended use of the turbomachine. Examples of numbers of fluid pressurizers considered suitable to include in a turbomachine include zero, one, at least one, two, a plurality, three, four, five, more than five, more than ten, and any other number considered suitable for a particular embodiment. For example, a plurality of fluid pressurizers can be disposed within a passageway. Examples of numbers of ducts considered suitable to include in a turbomachine include zero, one, at least one, two, a plurality, three, four, five, more than five, more than ten, one for each fluid pressurizer, two for each fluid pressurizer, a suction duct and an injection duct for one or more fluid pressurizers, or each fluid pressurizer, and any other number considered suitable for a particular embodiment. For example, a turbomachine can include one or more injection ducts and omit the inclusion of any suctions ducts, or vice versa, or the type of duct included in the fluid system could alternate along the circumference of a turbomachine. For example, in embodiments in which a casing defines a plurality of passageways, a fluid pressurizer can be included in each, or one or more, of the passageways and/or a suction duct and/or injection duct can be attached to the fluid pressurizer and/or a casing, as described herein. While the turbomachine 206 has been illustrated as including a plurality of ducts 260 that are entirely disposed within the passageway 242, a turbomachine can include any suitable number of ducts having any suitable portion disposed within a passageway. Selection of a suitable position to locate a duct can be based on various considerations, including the desired fluid flow through a turbomachine. Examples of suitable positions to locate a duct include those in which the entire duct is positioned within a passageway, a portion of a duct is positioned within a passageway (e.g., the second end is disposed in an environment exterior to a passageway), and any other position considered suitable for a particular embodiment. While each duct of the plurality of ducts 260 has been illustrated as being included in fluid system 10, a duct, as described herein, can be included in any suitable system, or provided separately, and used for any suitable purpose. Alternative embodiments of the ducts described herein can include a second end that defines a plurality of openings such that discrete jets of fluid can be provided to a suction port (e.g., in embodiments in which a suction duct defines a plurality of openings at the second end) and/or such that that discrete jets of fluid can be directed toward a blade, or a plurality of blades (e.g., in embodiments in which an injection duct defines a plurality of openings at the second end). An example of a duct that defines a plurality of openings 402 at the second end 368 is shown in FIG. 9. Alternative to including one or more ducts within a passageway defined by a casing, the casing can define structure similar to the ducts described herein (e.g., duct passageways, duct openings).

Any of the herein described examples of turbomachines, and any of the features described relative to a particular example of a turbomachine, can be included on any suitable device, system, or component, such as a diffuser, pump, compressor, axial flow compressor, centrifugal compressor, fan, cooling fan, industrial ventilation fan, engine, jet engine, aircraft engine, aircraft engine inlets, or a wing of a plane, jet, or another transportation vehicle, any system having an adverse pressure gradient (e.g., the pressure is increased in the direction of the flow of a fluid through the system), and any other device, system, or component. For example, any of the herein described embodiments, such as the turbomachines, casing treatments, and/or ducts, can be combined in any suitable manner and include any of the features, devices, systems, and/or components described in U.S. patent application Ser. No. 15/426,084 by Zha and filed on Feb. 7, 2017, which is incorporated by reference herein in its entirety, and/or U.S. patent application Ser. No.

15/255,523 by Zha and filed on Sep. 2, 2016, which is incorporated by reference herein in its entirety.

An example method for controlling a fluid passing through a turbomachine that includes a casing treatment includes the steps of: activating a turbomachine that includes a casing treatment, the turbomachine comprising: a wheel, a casing, and a fluid pressurizer disposed within a passageway defined by the casing and configured to pressurize fluid that passes through the passageway; and activating the fluid pressurizer such that fluid passing through the passageway is pressurized and exits a second passageway opening such that it is directed toward each blade of the plurality of blades. Any suitable turbomachine, such as those described herein, can be utilized in an example method. Any suitable casing treatment, such as those described herein, can be included in a turbomachine used in an example method.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. A turbomachine for compressing a fluid comprising:

a wheel having a hub and a plurality of blades, the hub defining a rotational axis, each blade of the plurality of blades having a root attached to the hub, a blade tip, a leading edge, and a trailing edge, each blade of the plurality of blades extending from the root to the blade tip and from the leading edge to the trailing edge;

a casing having a first end, a second end, and defining an inner surface surrounding the plurality of blades, an inlet opening, an outlet opening, a passageway, and a channel extending from the inlet opening to the outlet opening such that said fluid can enter the casing through the inlet opening, pass through the channel, and exit the outlet opening, the passageway extending from a first passageway opening defined on the inner surface and disposed between the first end of the casing and the second end of the casing and a second passageway opening defined on the inner surface and disposed between the first passageway opening and the first end of the casing such that said fluid can enter the passageway through the first passageway opening, pass through the passageway, and exit the passageway through the second passageway opening; and a fluid pressurizer disposed within the passageway and configured to pressurize said fluid that passes through the passageway, the fluid pressurizer having a suction port and a discharge port, the suction port directed toward a first portion of the passageway extending from the first passageway opening to the fluid pressurizer, the discharge port directed toward a second portion of the passageway extending from the second passageway opening to the fluid pressurizer;

wherein the passageway comprises a plurality of passageways, each passageway extending from a first passageway opening defined on the inner surface and disposed between the first end of the casing and the second end of the casing and a second passageway opening defined on the inner surface and disposed between the first passageway opening and the first end of the casing such that said fluid can enter each passageway through the first passageway opening and exit each passageway through the second passageway opening; and wherein the fluid pressurizer comprises a plurality of fluid pressurizers, a fluid pressurizer of the plurality of fluid pressurizers disposed in each passageway of the plurality of passageways.

2. The turbomachine of claim 1, wherein the plurality of passageways comprises between two passageways and a number of blades included in the plurality of blades.

3. The turbomachine of claim 1, wherein the plurality of passageways comprises between two and one hundred passageways.

4. The turbomachine of claim 1, wherein the casing has a circumference; and wherein the plurality of passageways is evenly distributed around the circumference of the casing.

5. The turbomachine of claim 1, wherein said fluid has a first pressure at the first passageway opening of each passageway of the plurality of passageways; and wherein said fluid has a second pressure at the second passageway opening of each passageway of the plurality of passageways that is greater than the first pressure.

6. The turbomachine of claim 5, wherein said fluid exiting each passageway of the plurality of passageways at the second passageway opening of each passageway of the plurality of passageways is directed toward the blade tip of a blade of the plurality of blades.

7. The turbomachine of claim 1, wherein the first passageway opening of each passageway of the plurality of passageways is disposed adjacent to the trailing edge of a blade of the plurality of blades.

8. The turbomachine of claim 1, wherein a portion of the casing that defines the second passageway opening of each passageway of the plurality of passageways is disposed at an angle relative to the inner surface, the angle being between about 0 degrees and about 90 degrees and taken along a plane that contains the rotational axis.

9. The turbomachine of claim 8, wherein said fluid exiting each passageway of the plurality of passageways at the second passageway opening of each passageway of the plurality of passageways is directed toward the blade tip at the leading edge of a blade of the plurality of blades.

10. The turbomachine of claim 1, wherein a portion of the casing that defines the second passageway opening of each passageway of the plurality of passageways is disposed at an angle relative to a plane that is orthogonal to the rotational axis, the angle being between about 0 degrees and about 180 degrees.

11. The turbomachine of claim 10, wherein the angle is between about 45 degrees and about 135 degrees.

12. The turbomachine of claim 1, wherein the first passageway opening of each passageway of the plurality of passageways has a first cross-sectional area and the second passageway opening of each passageway of the plurality of passageways has a second cross-sectional area that is less than the first cross-sectional area.

13. The turbomachine of claim 1, further comprising a duct disposed within each passageway of the plurality of passageways.

14. The turbomachine of claim 13, wherein the duct is attached to a fluid pressurizer of the plurality of fluid pressurizers.

15. The turbomachine of claim 1, wherein each fluid pressurizer of the plurality of fluid pressurizers is moveable between an on state and an off state.

16. A turbomachine for compressing a fluid comprising:

a wheel having a hub and a plurality of blades, the hub defining a rotational axis, each blade of the plurality of blades having a root attached to the hub, a blade tip, a leading edge, and a trailing edge, each blade of the plurality of blades extending from the root to the blade tip and from the leading edge to the trailing edge;

a casing having a first end, a second end, and defining an inner surface surrounding the plurality of blades, an inlet opening, an outlet opening, a plurality of passageways, and a channel extending from the inlet opening to the outlet opening such that said fluid can enter the casing through the inlet opening, pass through the channel, and exit the outlet opening, each passageway of the plurality of passageways extending from a first passageway opening defined on the inner surface and disposed between the first end of the casing and the second end of the casing and a second passageway opening defined on the inner surface and disposed between the first passageway opening and the first end of the casing such that said fluid can enter each passageway through the first passageway opening, pass through the passageway, and exit each passageway through the second passageway opening; and a plurality of fluid pressurizers, a fluid pressurizer of the plurality of fluid pressurizers disposed in each passageway of the plurality of passageways, each fluid pressurizer of the plurality of fluid pressurizers configured to pressurize said fluid that passes through a passageway of the plurality of passageways such that said fluid has a first pressure at the first passageway opening and said fluid has a second pressure at the second passageway opening that is greater than the first pressure, said fluid exiting a passageway of the plurality of passageways at the second passageway opening directed toward the blade tip, each fluid pressurizer of the plurality of fluid pressurizers having an on state, an off state, a suction port, and a discharge port.

17. The turbomachine of claim 16, wherein the first passageway opening of each passageway of the plurality of passageways is disposed adjacent to the trailing edge of a blade of the plurality of blades.

18. The turbomachine of claim 16, wherein the first passageway opening of each passageway of the plurality of passageways has a first cross-sectional area and the second passageway opening of each passageway of the plurality of passageways has a second cross-sectional area that is less than the first cross-sectional area.

19. The turbomachine of claim 16, further comprising a duct disposed within each passageway of the plurality of passageways.

20. The turbomachine of claim 19, wherein each duct is attached to a fluid pressurizer of the plurality of fluid pressurizers.

* * * * *